US009389541B1

(12) United States Patent
Yatsuda et al.

(10) Patent No.: US 9,389,541 B1
(45) Date of Patent: Jul. 12, 2016

(54) LIQUID DEVELOPER SUPPLY DEVICE AND IMAGE FORMING APPARATUS

(71) Applicant: FUJI XEROX CO., LTD., Tokyo (JP)

(72) Inventors: Kazutoshi Yatsuda, Kanagawa (JP); Kazunari Komatsuzaki, Kanagawa (JP); Taichi Yamada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/804,516

(22) Filed: Jul. 21, 2015

(30) Foreign Application Priority Data

Mar. 5, 2015 (JP) ..... 2015-043962

(51) Int. Cl.
*G03G 15/10* (2006.01)

(52) U.S. Cl.
CPC ..... *G03G 15/105* (2013.01)

(58) Field of Classification Search
CPC ... G03G 15/105; G03G 15/11; G03G 15/104; B41J 2/175; B41J 2/18
See application file for complete search history.

(56) References Cited

U.S. PATENT DOCUMENTS

2003/0175049 A1* 9/2003 Ichida ..... G03G 21/12 399/237
2009/0233214 A1* 9/2009 Hiraga ..... G03G 9/12 430/114
2013/0308984 A1* 11/2013 Sandler ..... B41J 2/175 399/237
2014/0301756 A1* 10/2014 Gijsbrechts ..... G03G 15/104 399/249

FOREIGN PATENT DOCUMENTS

JP 2003-173088 A 6/2003
JP 2004-117687 A 4/2004

* cited by examiner

*Primary Examiner* — Francis Gray
(74) *Attorney, Agent, or Firm* — Oliff PLC

(57) ABSTRACT

Provided is a liquid developer supply device including plural accommodation tubs that respectively accommodate a liquid developer, a high concentration liquid developer, a dilution liquid and a standard concentration liquid developer, a first detection section that detects a solid component concentration of the liquid developer, and an amount of the liquid developer that is accommodated in the accommodation tubs, and a control section that controls the solid component concentration of the liquid developer to within the concentration range by supplying at least one of the high concentration liquid developer and the dilution liquid to an accommodation tub in which the liquid developer is accommodated based on detection results that are detected by the first detection section, and controls the amount of the liquid developer to greater than or equal to a predetermined amount by supplying the standard concentration liquid developer.

9 Claims, 7 Drawing Sheets

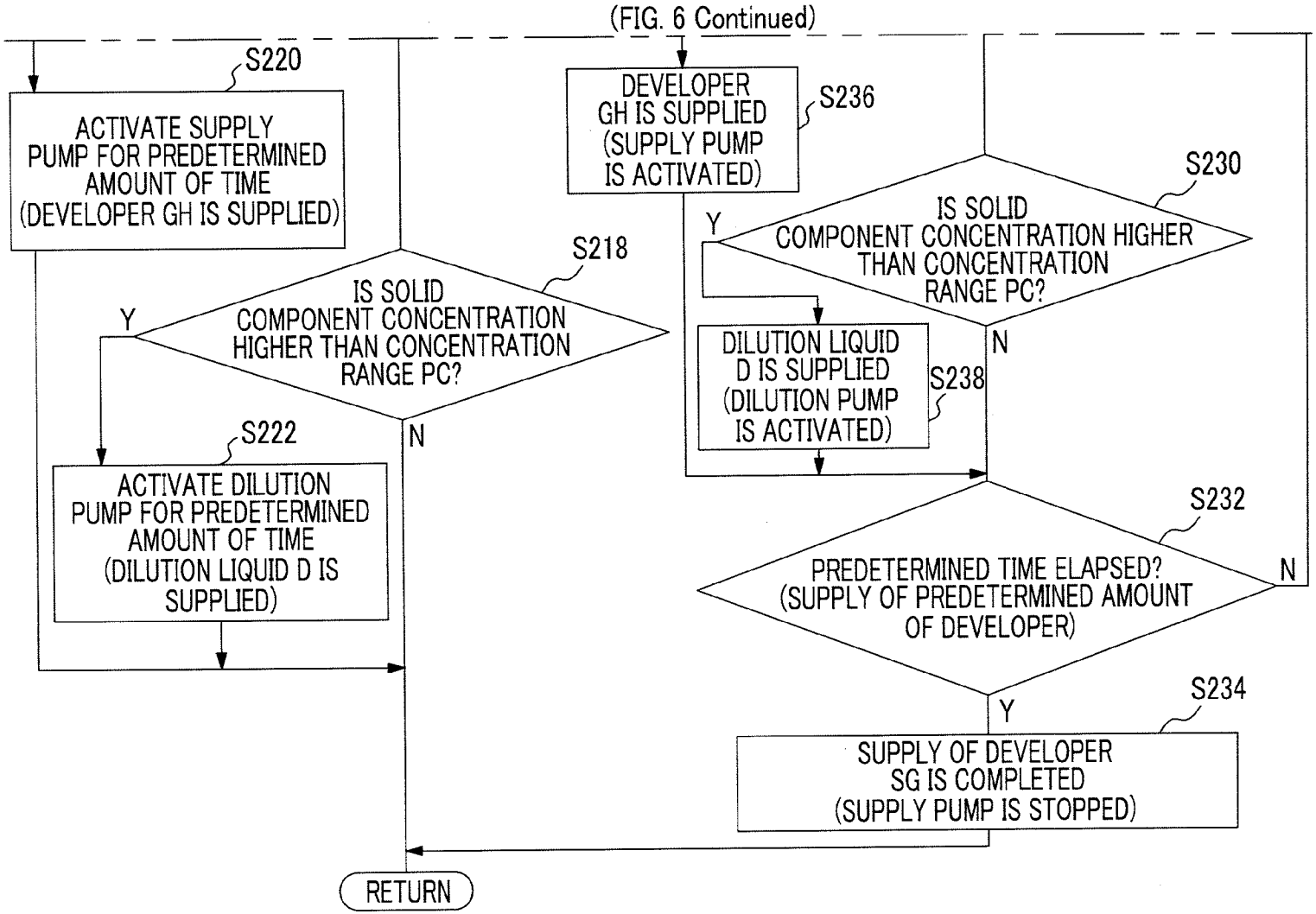
(FIG. 6 Continued)
S220
ACTIVATE SUPPLY PUMP FOR PREDETERMINED AMOUNT OF TIME (DEVELOPER GH IS SUPPLIED)
S218
IS SOLID COMPONENT CONCENTRATION HIGHER THAN CONCENTRATION RANGE PC?
Y
N
S222
ACTIVATE DILUTION PUMP FOR PREDETERMINED AMOUNT OF TIME (DILUTION LIQUID D IS SUPPLIED)
S236
DEVELOPER GH IS SUPPLIED (SUPPLY PUMP IS ACTIVATED)
S230
IS SOLID COMPONENT CONCENTRATION HIGHER THAN CONCENTRATION RANGE PC?
Y
N
S238
DILUTION LIQUID D IS SUPPLIED (DILUTION PUMP IS ACTIVATED)
S232
PREDETERMINED TIME ELAPSED? (SUPPLY OF PREDETERMINED AMOUNT OF DEVELOPER)
Y
N
S234
SUPPLY OF DEVELOPER SG IS COMPLETED (SUPPLY PUMP IS STOPPED)
RETURN

LIQUID DEVELOPER SUPPLY DEVICE AND IMAGE FORMING APPARATUS

CROSS-REFERENCE TO RELATED APPLICATIONS

This application is based on and claims priority under 35 USC 119 from Japanese Patent Application No. 2015-043962 filed Mar. 5, 2015.

BACKGROUND

Technical Field

The present invention relates to a liquid developer supply device and an image forming apparatus.

SUMMARY

According to an aspect of the invention, there is provided a liquid developer supply device including:

plural accommodation tubs that respectively accommodate a liquid developer that is used in image formation and includes toner as a solid component, a high concentration liquid developer in which a solid component concentration is higher than a predetermined concentration range, a dilution liquid and a standard concentration liquid developer in which a solid component concentration is adjusted to a target concentration within a concentration range;

a first detection section that detects a solid component concentration of the liquid developer, and an amount of the liquid developer that is accommodated in the accommodation tubs; and a control section that controls the solid component concentration of the liquid developer to within the concentration range by supplying at least one of the high concentration liquid developer and the dilution liquid to an accommodation tub in which the liquid developer is accommodated based on detection results that are detected by the first detection section, and controls the amount of the liquid developer to greater than or equal to a predetermined amount by supplying the standard concentration liquid developer.

BRIEF DESCRIPTION OF THE DRAWINGS

Exemplary embodiments of the present invention will be described in detail based on the following figures, wherein.

DETAILED DESCRIPTION

Figure 2:
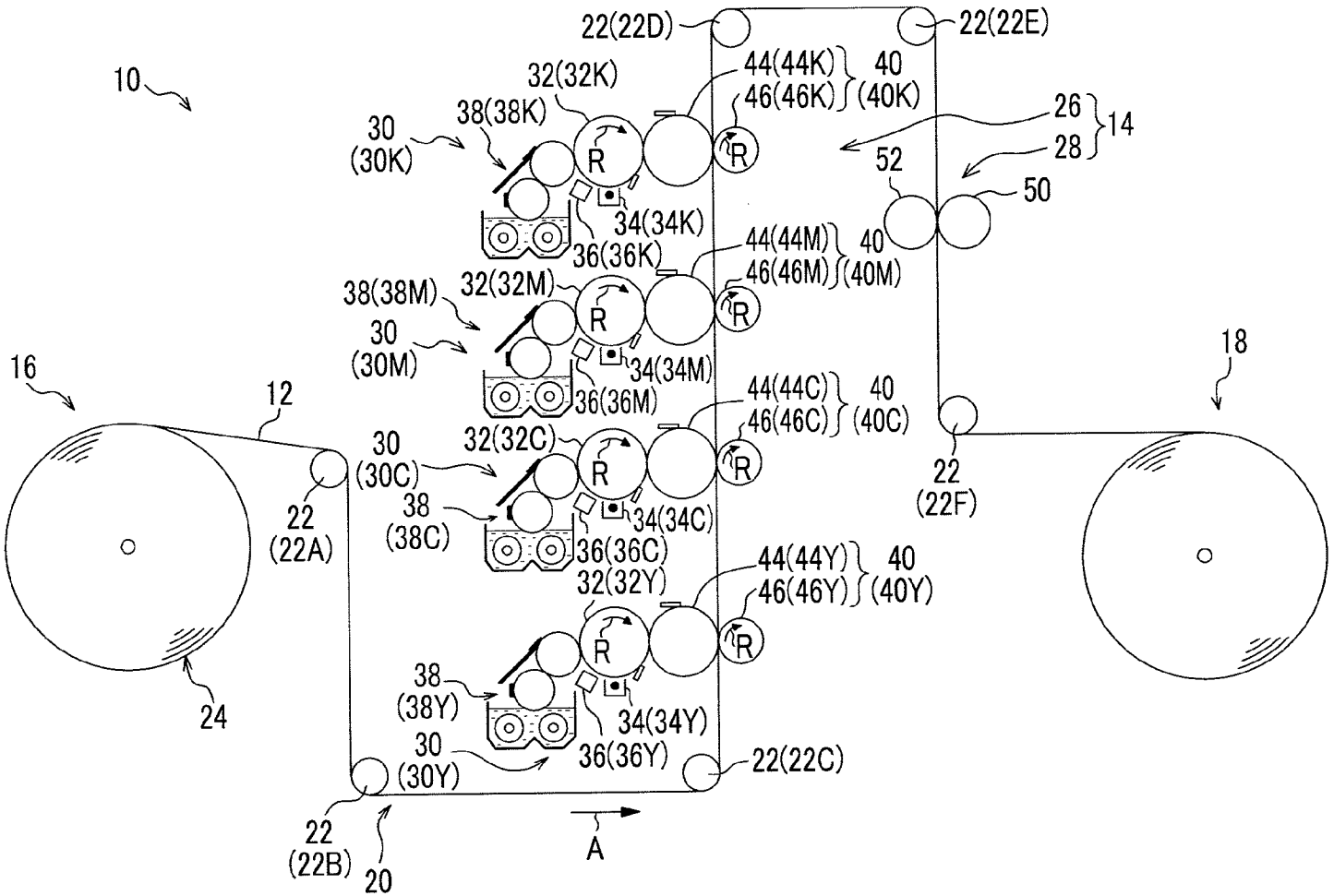
FIG. 2 shows a configuration of main sections of an example of an image forming apparatus according to the exemplary embodiment.

Hereinafter, the exemplary embodiment will be described in detail. FIG. 2 shows a configuration of the main sections of an image forming apparatus 10 according to the exemplary embodiment. The image forming apparatus 10 adopts an electrophotography method, and forms images that correspond to image data on a recording medium such as a film 12.

Image data from an image processing apparatus, which is connected through a communication line such as a dedicated or a public network line, for example, is input into the image forming apparatus 10. An image reading apparatus, which reads images recorded on a document, may be connected to the image forming apparatus 10, and image data, which is obtained by images that are recorded on a document being read by the image reading apparatus, may be input. The image forming apparatus forms images that correspond to image data on the longitudinal film 12, as one example, using a liquid developer. The image forming apparatus 10 is not limited to the longitudinal film 12, and may have a configuration that performs an image forming process on a sheet-form film. Alternatively, the image forming apparatus 10 is not limited to film, and may be used in image formation on various recording media such as recording sheets of paper.

The image forming apparatus 10 is provided with an image forming section 14, a supply section 16, and a discharge section 18. A transport path 20 of the film 12 is formed in the image forming apparatus 10. Plural transport rollers 22 (in FIG. 2, as an example, transport rollers 22A, 22B, 22C, 22D, 22E and 22F are illustrated. Referred to below as the transport rollers 22 in cases that do not discriminate between the transport rollers) are arranged in the transport path 20. In the exemplary embodiment, the transport path 20 and the transport rollers 22 function as an example of a transport unit. The film 12 is transported along the transport path 20 at a predetermined transport speed, as a result of at least a portion of the transport rollers 22 being driven to rotate (a transport direction is shown by an arrow F).

A film roll 24, in which the longitudinal film 12 is wound in roll-form, is loaded in the supply section 16. The film 12 is delivered to the transport path 20 by being drawn out from an outer circumferential end of the film roll 24, which is loaded in the supply section 16, and is transported from the supply section 16 to the discharge section 18 by passing through the image forming section 14.

The image forming section 14 is provided with a developing section 26 that develops electrostatic latent images and transfers the developed images to the film 12, and a fixing section 28 that is provided on a downstream side of the developing section 26 and that fixes images, which are transferred to the film 12, onto the film 12. The image forming section 14, which is provided in the image forming apparatus 10, forms toner pictures on the film 12 using liquid developers (hereinafter, referred to as developers) G of each color of Y, M, C and K (referred to as GY, GM, GC and GK in cases that discriminate between colors). In the following description, the symbol Y shows a composition for yellow, the symbol M shows a composition for magenta, the symbol C shows a composition for cyan, and the symbol K shows a composition for black.

The developing section 26 is provided with an image forming unit 30Y, which uses the developer GY that includes Y color toner, an image forming unit 30M, which uses the developer GM that includes M color toner, and an image forming unit 30C, which uses the developer GC that includes C color toner, as image forming units 30. The developing section 26 is provided with an image forming unit 30K, which uses the developer GK that includes K color toner, as the image forming units 30. The image forming units 30Y, 30M, 30C and 30K are arranged in the developing section 26 along the transport path 20 to face a surface of the film 12. In the exemplary embodiment, as an example, description is given using the image forming apparatus 10, which forms images on one surface of the longitudinal film 12, but the image forming apparatus may have a configuration that forms images on both surfaces of the longitudinal film 12. In this case, it is sufficient to set a configuration in which the image forming units 30 (30Y, 30M, 30C and 30K), which face one surface of the film 12, and the image forming units 30 (30Y, 30M, 30C and 30K), which face the other surface, are disposed in the image forming apparatus.

In the developing section 26, toner pictures that correspond to image data are formed by each color of the image forming units 30Y, 30M, 30C and 30K. The developing section 26 forms toner pictures (color toner pictures) that correspond to image data on the film 12 by overlapping and transferring toner pictures, which are formed by the image forming units 30Y, 30M, 30C and 30K, on the film 12. In the exemplary embodiment, the toner pictures function as an example of toner images. Detailed description of the image forming units 30 will be given later.

The fixing section 28 is provided with a fixing roller 50 and a pressurization roller 52. The fixing roller 50 is heated by a heating unit, which is not shown in the drawing, and an outer circumferential surface thereof is retained at a predetermined fixed temperature. In the fixing section 28, the film 12, onto which toner pictures are transferred, and which is delivered, is interposed between the fixing roller 50 and the pressurization roller 52, the film 12 is pressurized while being heated, and toner on the film 12 is melted and fixed on the film 12. As a result of this, the toner pictures are fixed, and the film 12 is sent out. Images that correspond to image data are formed by the toner pictures being fixed, and the film 12 is accommodated by being wound in roll form in the discharge section 18. The image forming apparatus 10 may adopt a publicly-known configuration that adopts an electrophotography method, and therefore, detailed description thereof will be omitted.

Figure 3:
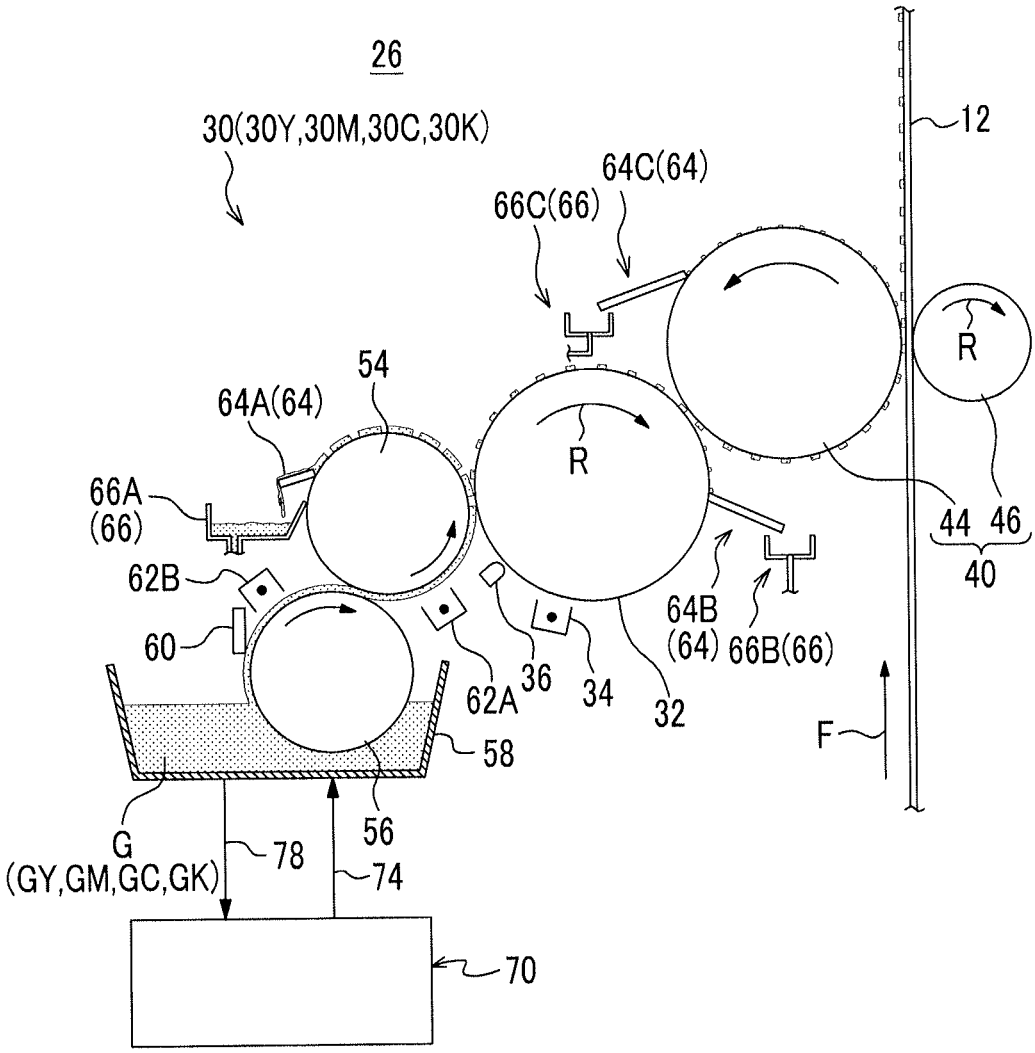
FIG. 3 shows a configuration of main sections of an example of an image forming unit.

FIG. 3 shows a configuration of the main sections of a single image forming unit 30. In the image forming units 30Y, 30M, 30C and 30K, the developer G that is used differs, but the basic configurations thereof are the same, and therefore, in the following description, the suffixes of the symbols Y, M, C and K that specify color will be omitted in cases that describe the basic configuration thereof.

As shown in FIGS. 2 and 3, the image forming unit 30 (30Y, 30M, 30C and 30K) is provided with a photoreceptor 32 (32Y, 32M, 32C and 32K), a charging device 34 (34Y, 34M, 34C and 34K), and an exposure device 36 (36Y, 36M, 36C and 36K). The image forming unit 30 (30Y, 30M, 30C and 30K) is provided with a developing device 38 (38Y, 38M, 38C and 38K), and a transfer device 40 (40Y, 40M, 40C and 40K).

As an example, the photoreceptor 32 is formed in cylindrical shape, and holds an electrostatic latent image on the outer circumferential surface thereof. The photoreceptor 32 is caused to rotate toward a predetermined direction (an arrow R direction in FIGS. 2 and 3) that depends on a transport speed of the film 12, which is transported through the transport path 20. In the image forming unit 30, the charging device 34, the exposure device 36, the developing device 38, and the transfer device 40 are disposed in order in the vicinity of the photoreceptor 32 along a rotational direction of the photoreceptor 32, and respectively face the outer circumferential surface of the photoreceptor 32.

For example, the charging device 34 uses a corotron, a scorotron or the like, and the outer circumferential surface of the photoreceptor 32, which faces the charging device 34, is charged as a result of a predetermined charging voltage being applied. The exposure device 36 irradiates the outer circumferential surface of the charged photoreceptor 32 with optical beams, which are generated depending on image data, while scanning the outer circumferential surface of the charged photoreceptor 32. As a result of this, an electrostatic latent image that depends on image data is formed on the outer circumferential surface of the photoreceptor 32.

The developing device 38 develops the electrostatic latent image that is formed on the outer circumferential surface of the photoreceptor 32 by supplying the developer G, which includes toner, to the outer circumferential surface of the photoreceptor 32, on which an electrostatic latent image is formed. As a result of this, a toner picture that depends on image data is formed on the outer circumferential surface of the photoreceptor 32.

The transfer device 40 is provided with an intermediate transfer roller 44 (44Y, 44M, 44C and 44K), and a transfer roller 46 (46Y, 46M, 46C and 46K). The outer circumferential surface of the intermediate transfer roller 44 comes into contact with the outer circumferential surface of the photoreceptor 32 at a predetermined position (a primary transfer position), which is further on a downstream side in the rotational direction of the photoreceptor 32 than the developing device 38, and is slave driven with respect to the photoreceptor 32. In addition, the intermediate transfer roller 44 is arranged so that the outer circumferential surface thereof comes into contact with the film 12, which is transported through the transport path 20, at a secondary transfer position, which differs from the primary transfer position. The transfer roller 46 is disposed facing the intermediate transfer roller 44 with the transport path 20 interposed therebetween at the secondary transfer position, and is rotated so as to send the film 12 out (rotation toward the arrow R direction).

In the image forming unit 30, toner pictures, which are formed on the photoreceptor 32 as a result of a primary transfer voltage being applied from a power source apparatus, which is not shown in the drawing, to the intermediate transfer roller 44, are primarily transferred to the outer circumferential surface of the intermediate transfer roller 44 at the primary transfer position. In the image forming unit 30, toner pictures, which are transferred to the intermediate transfer roller 44 as a result of a secondary transfer voltage being applied from a power source apparatus, which is not shown in the drawing, to the transfer roller 46, are transferred onto the film 12 at the secondary transfer position.

Meanwhile, as shown in FIG. 3, as an example, the developing device 38 according to the exemplary embodiment is provided with a developing roller 54 and a supply roller 56, the external shapes of which are respectively formed to be cylindrical. In the exemplary embodiment, as the developer G, a liquid developer that includes toner as a solid component is used, and the developing device 38 is provided with a developing tank 58 in which the developer G, which is a liquid developer, is accommodated. A portion of the outer circumferential surface of the supply roller 56 is soaked in the developer G inside the developing tank 58. The developing roller 54 is disposed so that the outer circumferential surface thereof touches the outer circumferential surface of the photoreceptor 32, on which an electrostatic latent image is formed, and follows the rotation of the photoreceptor 32. The outer circumferential surface of the supply roller 56 touches the outer circumferential surface of the developing roller 54, and the supply roller 56 follows the rotation of the developing roller 54. A blade 60 opposes the supply roller 56 further on a downstream side in the rotational direction than a position that is soaked in the developer G. The blade 60 adjusts the thickness of a layered film of the developer G that is adhered to the outer circumferential surface of the supply roller 56.

Furthermore, as an example, the developing device 38 is provided with a charging device 62A, which faces the outer circumferential surface of the developing roller 54, and a charging device 62B, which faces the outer circumferential surface of the supply roller 56. For example, a corotron, a scorotron or the like, is used in the charging devices 62A and 62B.

In the developing device 38, the developer G in the developing tank 58 is drawn up and carried out by being adhered to the outer circumferential surface of the supply roller 56 as a result of rotation of the supply roller 56. The thickness of a layered film of the developer G that is adhered to the supply roller 56 is adjusted by the blade 60.

For example, the charging device 62B is disposed further on an upstream side in the rotational direction of the supply roller 56 than a contact position between the developing roller 54 and the supply roller 56, and charges the toner inside the developer G, which is adhered to the outer circumferential surface of the supply roller 56. The developer G, which is adhered to the supply roller 56, adheres to the outer circumferential surface of the developing roller 54, and a thin film of the developer G is formed as a result of a supply voltage being applied from a power source apparatus, which is not shown in the drawing.

For example, the charging device 62A is disposed further on a downstream side in the rotational direction of the developing roller 54 than a contact position between the developing roller 54 and the supply roller 56, and further on an upstream side in the rotational direction of the developing roller 54 than a contact position between the photoreceptor 32 and the developing roller 54. The charging device 62A charges the toner inside the developer G, which is adhered to the outer circumferential surface of the developing roller 54, to a predetermined polarity (for example, a positive polarity). In the developing device 38, the toner in the developer G, which is adhered to the developing roller 54, is adhered to the photoreceptor 32 depending on an electrostatic latent image, which is formed on the photoreceptor 32, as a result of a developing voltage being applied between the photoreceptor 32 and the developing roller 54 from a power source apparatus, which is not shown in the drawing. As a result of this, the electrostatic latent image is developed by the toner, and a toner picture is formed on the photoreceptor 32.

Meanwhile, the image forming unit 30 is provided with a recovery unit that recovers liquid developer G, among the developer G that is carried out from the developing tank 58, which is not used in image formation on the film 12. The recovery unit is provided with blades 64, longitudinal directions of which run along axial directions of each roller, and in which end sides of a width direction touch the outer circumferential surfaces of each roller, and reception containers 66, longitudinal directions of which are open along the longitudinal directions of the blades 64.

A blade 64A and a reception container 66A face the developing roller 54 further on a downstream side in the rotational direction than a contact position with the photoreceptor 32. The blade 64A removes developer G that remains on the outer circumferential surface of the developing roller 54 by scraping the developer G away, and the reception container 66A recovers the developer G which the blade 64A scrapes away. A blade 64B and a reception container 66B face the photoreceptor 32 further on a downstream side in the rotational direction than a contact position with the intermediate transfer roller 44. The blade 64B removes developer G (mainly toner) that remains on the outer circumferential surface of the photoreceptor 32 by scraping the developer G away, and the reception container 66B recovers the developer G which the blade 64B scrapes away. A blade 64C and a reception container 66C face the intermediate transfer roller 44 further on a downstream side in the rotational direction than a contact position (a transfer position) with the film 12. The blade 64C removes developer G (mainly toner) that remains on the outer circumferential surface of the intermediate transfer roller 44 by scraping the developer G away, and the reception container 66C recovers the developer G which the blade 64C scrapes away.

Figure 1:
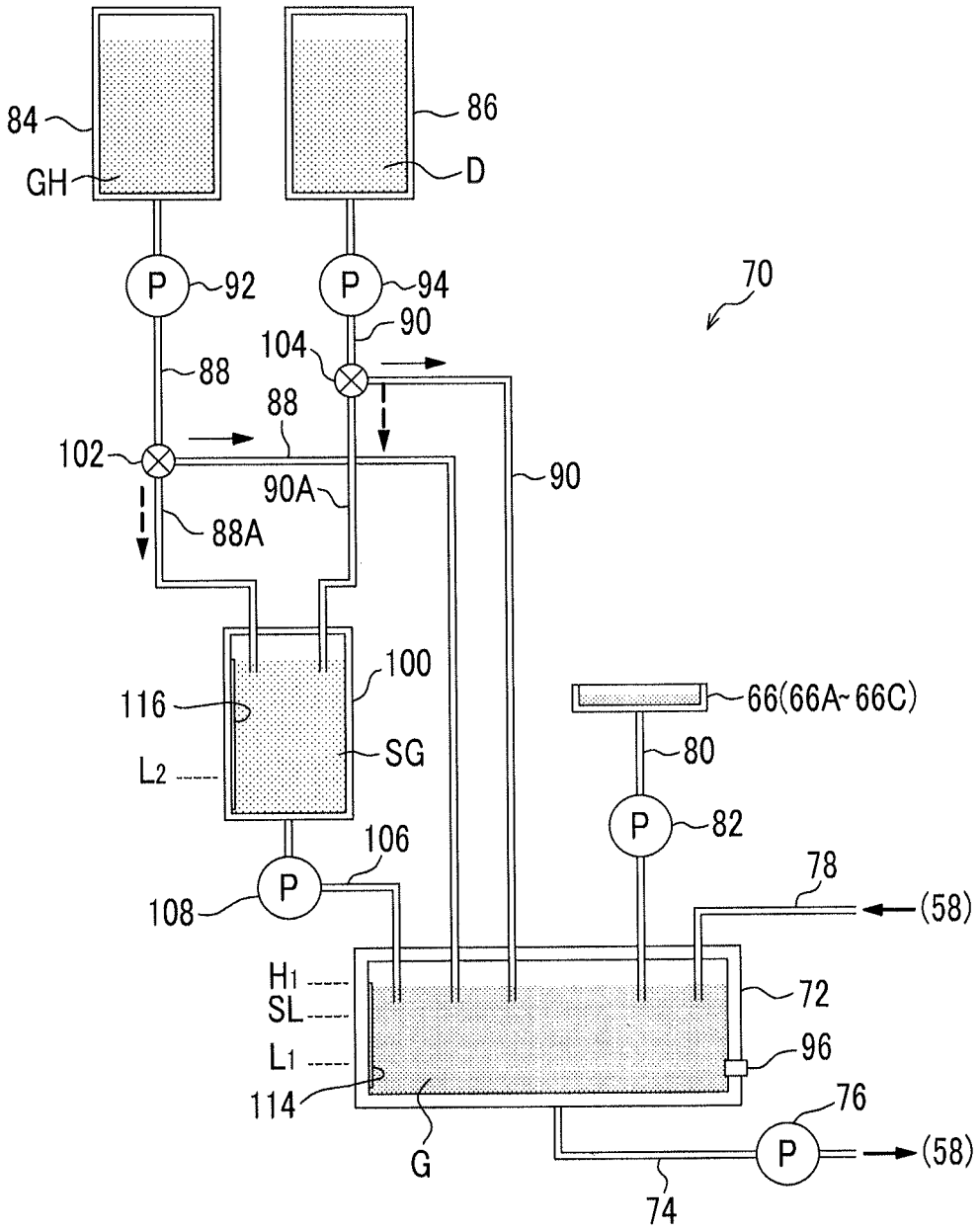
FIG. 1 shows a piping system of main sections of an example of a developer apparatus according to an exemplary embodiment.

Meanwhile, the image forming apparatus 10 is provided with a developer apparatus that supplies the developer G to the respective developing tanks 58 of the image forming units 30. FIG. 1 shows a developer apparatus 70 according to the exemplary embodiment. The developer apparatus 70 of the exemplary embodiment functions as an example of a liquid developer supply device. The developer apparatus 70 supplies the developer G to the respective developing tanks 58 of the image forming units 30Y, 30M, 30C and 30K of the image forming apparatus 10. In the developer apparatus 70, a supply system of the developer G is provided for each color (toner color) of the developer G, which is used in the image forming apparatus 10. Additionally, in the supply systems of the developer G of each color that is used in the developer apparatus 70, the color of the developer G (the toner color) that is supplied differs, but the basic configurations thereof are the same, and therefore, hereinafter, a single supply system will be described as an example without discriminating between colors (developers G).

As shown in FIG. 1, a developer tub 72, which accommodates the developer G, is provided in the developer apparatus 70. In the exemplary embodiment, among a plural accommodation tubs, the developer tub 72 functions as an example of an accommodation tub that accommodates a liquid developer.

In the developer G according to the exemplary embodiment, a liquid developer that includes toner as a solid component is used. In the image forming apparatus 10, changes in a solid component concentration SC of the developer G cause changes in the concentration of the images that are formed on the film 12, and the like, and have an effect on the quality and the like of the image that is formed on the film 12. Because of this, for example, a lower limit value (lower limit concentration $PR_L$) and an upper limit value (upper limit concentration $PR_H$) of a range (a range in concentration) PR of the solid component concentration SC of the developer G in which images of a desired quality are formed on the film 12, are set in the image forming apparatus 10 ($PR_L \leq SC \leq PR_H$).

As an example, the developer apparatus 70 performs concentration adjustment so that a concentration range PC which is narrower than the concentration range PR that is set in the image forming apparatus 10 is set for the solid component concentration SC of the developer G, and the solid component concentration SC of the developer G that is accommodated in the developer tub 72 becomes the concentration range PC. For example, when a lower limit concentration is set as $PC_L$, and an upper limit concentration is set as $PC_H$, the concentration range PC is set so that $PR_L < PC_L < PC_H < PR_H$, and the solid component concentration SC is adjusted so that $PR_L < PC_L \leq SC \leq PC_H < PR_H$. The developer apparatus 70 supplies the developer G in the developer tub 72, the concentration of which is adjusted, to the developing tank 58 of the developing device 38.

An end of a liquid feed pipe 74 is open in the bottom section of the developer tub 72, and the other end of the liquid feed pipe 74, which is not shown in the drawing, is open in the developing tank 58 (refer to FIG. 3) of the developing device 38. A liquid supply pump 76 is provided in an intermediate section of the liquid feed pipe 74. An end of a recovery pipe 78 is open in the developer tub 72, and the other end of the recovery pipe 78, which is not shown in the drawing, is open in the developing tank 58 (refer to FIG. 3) of the developing device 38.

In the developer apparatus 70, the developer G in the developer tub 72 is supplied to the developing tank 58 of the developing device 38 through the liquid feed pipe 74 as a result of the liquid supply pump 76 being activated. The developer G, which becomes surplus in the developing tank 58 of the developing device 38 (for example, the developer G that is recovered by an overflow unit, which is provided in the developing tanks 58, and is not shown in the drawing) as a result of the developer G in the developer tub 72 being supplied to the developing tank 58 of the developing device 38, is returned to the developer tub 72 through the recovery pipe 78.

An end of a recovery pipe 80 is open in the developer tub 72. The other end of the recovery pipe 80 is open in the bottom section of the reception containers 66 (66A to 66C), and a recovery pump 82 is provided in an intermediate section of the recovery pipe 80. In the exemplary embodiment, the blades 64 (64A to 64C), the reception containers 66 (66A to 66C) (refer to FIG. 3 for both components), the recovery pipe 80, and the recovery pump 82 function as an example of a recovery unit.

In the image forming unit 30, the developer G that is carried out from the developing tank 58 of the developing device 38, but is not used in image formation, is respectively recovered in the reception containers 66. In the developer apparatus 70, the developer G, which is respectively recovered by the reception containers 66, is recovered in the developer tub 72, and is reused in image formation as a result of the recovery pump 82 being activated.

A high concentration developer tub 84, which stores developer GH that is set to a concentration SCH in which the solid component concentration SC is higher than that of the developer G, which is stored in the developer tub 72 (for example, developer that is set so that the concentration SCH>the upper limit concentration $PR_H$), is provided in the developer apparatus 70. A dilution liquid tub 86, which accommodates a dilution liquid (for example, in which the solid component concentration SC=0) D such as a carrier liquid, which is used in the dilution of the developer GH, is provided in the developer apparatus 70. In the exemplary embodiment, among a plural accommodation tubs, the high concentration developer tub 84 functions as an example of an accommodation tub that accommodates a high concentration liquid developer. The dilution liquid tub 86 functions as an example of an accommodation tub that accommodates a dilution liquid among plural accommodation tubs.

An end of a liquid feed pipe 88 is open in the bottom section of the high concentration developer tub 84, and the other end of the liquid feed pipe 88 is open in the developer tub 72. An end of a liquid feed pipe 90 is open in the bottom section of the dilution liquid tub 86, and the other end of the liquid feed pipe 90 is open in the developer tub 72. A supply pump 92 is provided in an intermediate section of the liquid feed pipe 88, and a dilution pump 94 is provided in an intermediate section of the liquid feed pipe 90.

A concentration sensor 96, which is used in the detection of the solid component concentration SC of the developer G, is provided in the developer tub 72. In the exemplary embodiment, the concentration sensor 96 functions as an example of a detection section. For example, as the concentration sensor 96, an optical type sensor may be used, and changes in the amount of light which depend on the solid component concentration SC that is included in the developer G are detected. As the concentration sensor 96, it is also possible to use a permeability type optical sensor, and it is also possible to use a reflectivity type optical sensor. The concentration sensor 96 is not limited to an optical type sensor, and may be an ultrasonic wave sensor, or may have a configuration that detects the viscosity or the specific gravity of the developer G, which changes depending on the solid component concentration of the developer G.

In the developer apparatus 70, the supply pump 92 and the dilution pump 94 are activated depending on the solid component concentration SC of the developer G in the developer tub 72, which is detected by the concentration sensor 96, and the solid component concentration SC of the developer G is adjusted to the predetermined concentration range PC ($PC_L \leq SC \leq PC_H$).

Meanwhile, the developer apparatus 70 is provided with a standard developer tub 100. In the exemplary embodiment, among a plural accommodation tubs, the standard developer tub 100 functions as an accommodation tub that accommodates a high concentration liquid developer. As an example, the developer apparatus 70 prepares a developer SG, which is accommodated in the standard developer tub 100, using the developer GH and the dilution liquid D. For example, in the developer SG, a concentration within the predetermined concentration range PC is set as a target concentration TC, and the solid component concentration SC is adjusted so as to become the target concentration TC (SC=TC). For example, an intermediate value ($TC=(PC_H+PC_L)/2$) between the lower limit concentration $PC_L$ and the upper limit concentration $PC_H$ of the concentration range PC is used as the target concentration TC, and as long as the target concentration TC is within the concentration range PC, the target concentration TC is not limited to this value.

In the liquid feed pipe 88, a switching valve 102 is provided further on a downstream side (the developer tub 72 side) than the supply pump 92. In the liquid feed pipe 90, a switching valve 104 is provided further on a downstream side (the developer tub 72 side) than the dilution pump 94. Electromagnetic type valves (electromagnetic valves) or the like, which activate and switch a flow path of liquid depending on an electrical signal, are used as the switching valves 102 and 104. An end of a branched pipe 88A is connected to the switching valve 102, and the other end of the branched pipe 88A is open in the standard developer tub 100. An end of a branched pipe 90A is connected to the switching valve 104, and the other end of the branched pipe 90A is open in the standard developer tub 100. In the developer apparatus 70, a supply target of the developer GH is switched to either one of the developer tub 72 (shown by a solid line arrow in FIG. 1) and the standard developer tub 100 (shown by a dotted line arrow in the figure) by the switching valve 102. In the developer apparatus 70, a supply target of the dilution liquid D is switched to either one of the developer tub 72 (shown by a solid line arrow in FIG. 1) and the standard developer tub 100 (shown by a dotted line arrow in the figure) by the switching valve 104. In the developer apparatus 70, the developer GH and the dilution liquid D are supplied to the standard developer tub 100 by the supply targets of the developer GH and the dilution liquid D being set to the standard developer tub 100 using the switching valves 102 and 104, and the supply pump 92 and the dilution pump 94 being activated.

An end of a liquid feed pipe 106 is open in the bottom section of the standard developer tub 100, and the other end of the liquid feed pipe 106 is open in the developer tub 72. A supply pump 108 is provided in an intermediate section of the liquid feed pipe 106. The developer apparatus 70 supplies the developer SG, which is accommodated in the standard developer tub 100, to the developer tub 72 by activating the supply pump 108.

Figure 4:
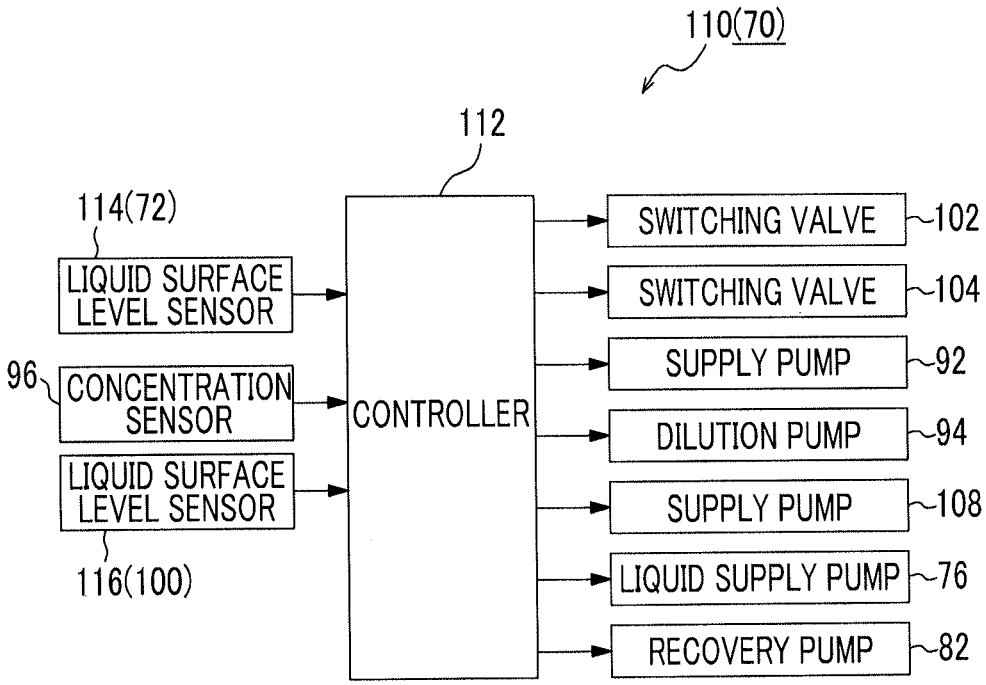
FIG. 4 shows a configuration of main sections of an example of a control section of the developer apparatus.

FIG. 4 shows an example of a control section 110 that controls the activation of the developer apparatus 70. The control section 110 is provided with a controller 112. In the controller 112, for example, a computer (not shown in the drawings) to which a Central Processing Unit (CPU), a Random Access Memory (RAM), non-volatile memory such as a Read Only Memory (ROM), a Hard Disk Drive (HDD), and the like, are connected using a bus, various I/O interfaces, various driver circuits, and the like are provided. The controller 112 functions as a control section that controls the activation of the developer apparatus 70 as a result of the CPU executing programs, which are stored in the non-volatile memory. For example, the controller 112 collectively controls the supply system for each color of developer G that is provided in the developer apparatus 70.

Additionally, programs and the like, which are executed by the CPU, may be stored on storage media such as a CD-ROM or a DVD, and the programs may be executed by being read by a CD-ROM drive, a DVD drive or the like that is connected to the computer. The programs and the like, which are executed by the CPU, may be executed by being acquired by the computer through a communication line. Furthermore, the controller 112 is not limited to a configuration that functions as a result of software that is executed by a computer, and may be configured by hardware.

The liquid supply pump 76, which supplies the developer G from the developer tub 72 to the developing tank 58 of the developing device 38, and the recovery pump 82 are connected to the controller 112. The controller 112 performs the supply of the developer G to the developing tank 58 of the developing device 38, and the recovery of supplied developer G by controlling the activation of the liquid supply pump 76 and the recovery pump 82.

The supply pump 92 and the switching valve 102, which are provided in the liquid feed pipe 88, and the dilution pump 94 and the switching valve 104, which are provided in the liquid feed pipe 90 are connected to the controller 112. The controller 112 supplies the developer GH and the dilution liquid D to the developer tub 72, and supplies the developer GH and the dilution liquid D to the standard developer tub 100 by controlling the activation of the supply pump 92, the dilution pump 94, the switching valve 102 and the switching valve 104.

The supply pump 108, which is provided in the liquid feed pipe 106, is connected to the controller 112. The controller 112 supplies the developer GH of the standard developer tub 100 to the developer tub 72 by controlling the activation of the supply pump 108. For example, as the supply pumps 92 and 108, and the dilution pump 94, a constant flow rate pump is used, and the supply amounts of the developer GH, the developer SG and the dilution liquid D are controlled as a result of the activation times thereof being controlled.

The concentration sensor 96, which is provided in the developer tub 72 is connected to the controller 112. A liquid surface level sensor 114, which is provided in the developer tub 72, and a liquid surface level sensor 116, which is provided in the standard developer tub 100 are connected to the controller 112. In the exemplary embodiment, a liquid surface level is detected as an example of the detection of an amount of the developer G that is accommodated in the developer tub 72. In the exemplary embodiment, a liquid surface level is detected as an example of the detection of an amount of the developer SG that is accommodated in the standard developer tub 100. In the exemplary embodiment, the liquid surface level sensor 114 functions as an example of a detection section, and the liquid surface level sensor 116 functions as another example of a detection section.

As shown in FIG. 1, the liquid surface level sensor 114, which is provided in the developer tub 72 detects a lower limit (a lower limit level $L_1$) and an upper limit (an upper limit level $H_1$) of a liquid surface of the developer G that is accommodated in the developer tub 72, for example. The liquid surface level sensor 116, which is provided in the standard developer tub 100 detects a lower limit (a lower limit level $L_2$) of a liquid surface of the developer SG that is accommodated in the standard developer tub 100, for example.

The controller 112 that is shown in FIG. 4 performs concentration adjustment so that the solid component concentration SC of the developer G is within the predetermined concentration range PC ($PC_L \leq SC \leq PC_H$) by supplying either one of the developer GH and the dilution liquid D to the developer tub 72 based on the solid component concentration SC that is detected by the concentration sensor 96.

When, according to the liquid surface level sensor 114, the liquid surface level of the developer G inside the developer tub 72 falls to the predetermined lower limit level $L_1$, for example, the controller 112 supplies a predetermined amount of the developer SG from the standard developer tub 100 to the developer tub 72 by activating the supply pump 108 for a predetermined period of time only. The predetermined amount of the developer SG is set as an amount that the liquid surface level of the developer G inside the developer tub 72 reaches a predetermined level SL (refer to FIG. 1) between the lower limit level $L_1$ and the upper limit level $H_1$, and is set as an amount at which additional supply of either one of the developer GH or the dilution liquid D is possible. As a result of this, in the developer apparatus 70, the supply of the developer GH and the dilution liquid D based on a detection result of the concentration sensor 96 is permitted during the supply of or after the supply of developer SG to the developer tub 72.

Furthermore, when, according to the liquid surface level sensor 116, the liquid surface level of the developer SG inside the standard developer tub 100 falls to the predetermined lower limit level $L_2$, the controller 112 supplies a predetermined amount of the developer GH and the dilution liquid D to the standard developer tub 100 by activating the switching valves 102 and 104 and switching the supply target of the developer GH and the dilution liquid D to the standard developer tub 100.

When at least the liquid surface level sensor 114 of the developer tub 72 reaches the lower limit level $L_1$, the lower limit level $L_2$, which is detected by the liquid surface level sensor 116 is set to the amount of the developer SG, which is supplied to the developer tub 72, that is remaining inside the standard developer tub 100. The amounts of the developer GH and the dilution liquid D that are supplied to the standard developer tub 100 are set as amounts at which the liquid surface level of the standard developer tub 100 reaches a predetermined level. A ratio of an amount of the developer GH to an amount of the dilution liquid D is set to a ratio that is established so that the developer SG in the target concentration TC is adjusted by the developer GH and the dilution liquid D that are supplied based on the solid component concentration SCH of the developer GH and the predetermined target concentration TC inside the concentration range PC. As a result of this, in the developer apparatus 70, when the predetermined amounts of the developer GH and the dilution liquid D are supplied to the standard developer tub 100, a developer SG in which the solid component concentration SC is prepared to the target concentration TC (SC=TC), is obtained.

In the developer apparatus 70, stirring units, which are not shown in the drawing, are provided in the developer tub 72 and the standard developer tub 100. As a result of this, in the developer apparatus 70, the developer G that is recovered to the developer tub 72, the developers GH and SG that are supplied to the developer tub 72, and the dilution liquid D are stirred, and the generation of concentration unevenness in the solid component concentration SC in the developer G in the developer tub 72, is suppressed. In the developer apparatus 70, the developers GH and the dilution liquid D that are supplied to the standard developer tub 100 are stirred, and the generation of concentration unevenness in the solid component concentration SC in the developer SG in the standard developer tub 100, is suppressed.

Hereinafter, an example of a developer supply process in the developer apparatus 70 according to the exemplary embodiment will be described. When an operation for the image forming apparatus 10 to form images on the film 12 is initiated, the developer apparatus 70 initiates an operation. When operation is initiated, the developer apparatus 70 activates the liquid supply pump 76 and the recovery pump 82, and supplies the developer G in the developer tub 72 to the developing tank 58 of the developing device 38. In addition, the developer apparatus 70 recovers the developer G which becomes surplus in the developing tank 58 of the developing device 38, and the developer G which has been carried out from the developing tank 58 by the supply roller 56 and not used in image formation (which becomes surplus in the image forming unit 30).

In the image forming apparatus 10, the developer G and toner that is included in the developer G (a solid component) are consumed as a result of performing image formation using the developer G that is supplied to the developing tank 58 of the developing device 38. There are cases in which the total amount of the developer G that is used in the image forming apparatus 10 is reduced due to vaporization and the like.

Because of this, for example, when operation is initiated, the developer apparatus 70 performs concentration adjustment of the solid component concentration SC of the developer G that is accommodates in the developer tub 72 using the developer GH and the dilution liquid D for a period until the operation is completed. The standard developer tub 100, which accommodates the developer SG of target concentration TC in which there is a predetermined solid component concentration SC, is provided in the developer apparatus 70. When the developer G in the developer tub 72 is reduced, the developer apparatus 70 performs adjustment (an increase in amount) of the amount of the developer G inside the developer tub 72 by supplying the developer G of the standard developer tub 100 to the developer tub 72. Furthermore, the developer apparatus performs preparation of the developer SG, which is accommodated in the standard developer tub 100 by supplying the developer GH and the dilution liquid D to the standard developer tub 100.

Figure 5:
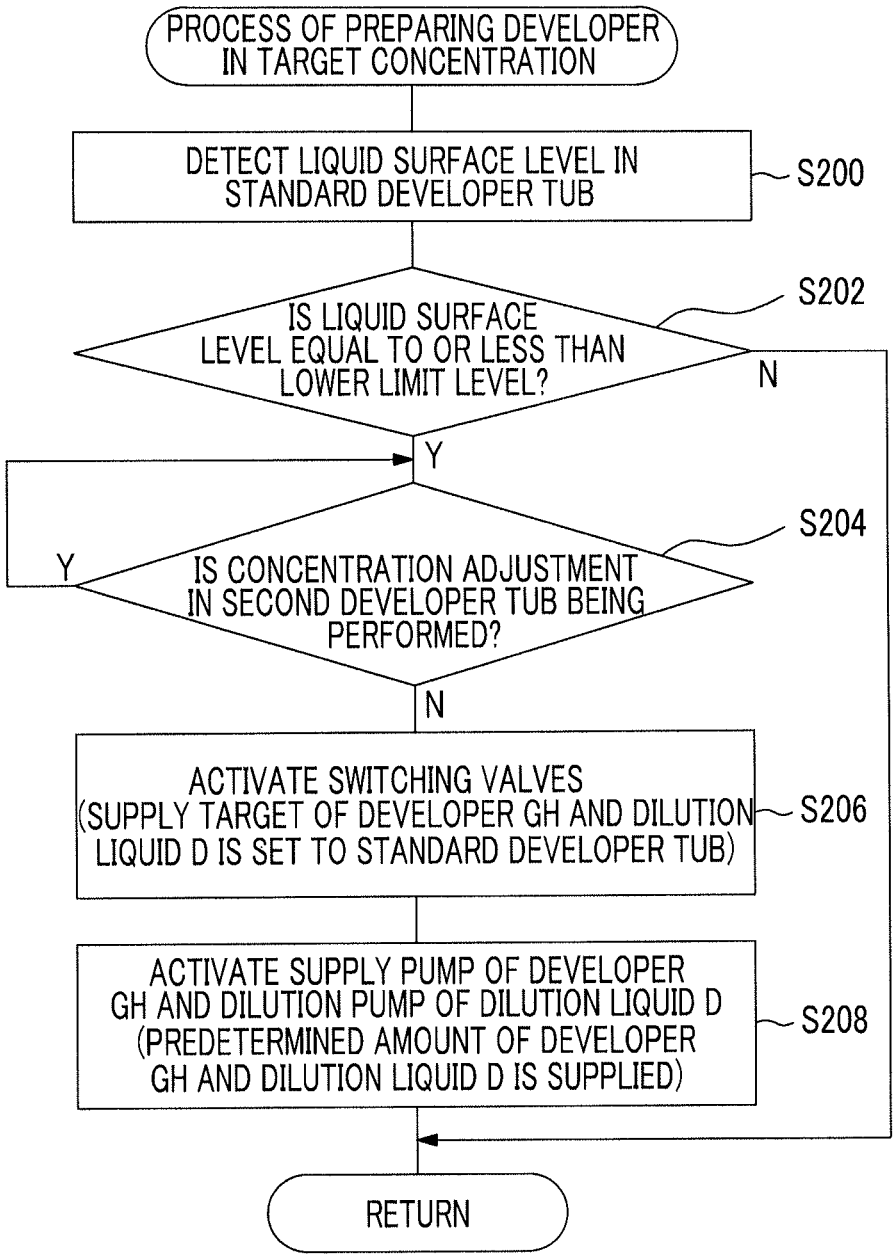
FIG. 5 is a flowchart that shows an example of preparing a developer which is accommodated in a standard developer tub.

FIG. 5 shows an example of the process of preparing the developer SG in the target concentration TC which is accommodated in the standard developer tub 100. This flowchart is executed during a predetermined time interval after the developer apparatus 70 initiated operation, and in the initial Step S200, the liquid surface level of the developer SG in the standard developer tub 100 is detected, which is detected by the liquid surface level sensor 116. In the next Step S202, it is confirmed whether or not the liquid surface level reaches the predetermined lower limit level $L_2$.

When the developer G in the developer tub 72 is reduced, the developer apparatus 70 supplies the developer SG from the standard developer tub 100 to the developer tub 72, and the developer SG in the standard developer tub 100 is reduced with supply of the developer SG to the developer tub 72. As a result of this, when the developer SG in the standard developer tub 100 is reduced, and the liquid surface level reaches less than or equal to the lower limit level $L_2$, a positive determination is made in Step S202, and the process moves to Step S204.

In the exemplary embodiment, as an example, concentration adjustment of the solid component concentration SC of the developer G in the developer tub 72, and preparation of the developer SG in the standard developer tub 100 are performed using the supply pump 92 in the supply of the developer GH, and using the dilution pump 94 in the supply of the dilution liquid D to the developer tub 72 and the standard developer tub 100. Because of this, in Step S204, the developer apparatus 70 stands by until concentration adjustment is completed in a case in which it is confirmed whether or not the concentration adjustment of the solid component concentration SC with respect to the developer G in the developer tub 72 is being performed, and concentration adjustment is being performed.

When concentration adjustment of the solid component concentration SC with respect to the developer G in the developer tub 72 is not being performed, or concentration adjustment is completed, a positive determination is made in Step S204, and the process moves to Step S206. In Step S206, the developer GH of the high concentration developer tub 84 and the dilution liquid D of the dilution liquid tub 86 are supplied to the standard developer tub 100 as a result of the switching valves 102 and 104 being activated.

Subsequently, in Step S208, the supply pump 92 and the dilution pump 94 are respectively activated for predetermined periods. As a result of this, a predetermined amount of the developer GH is supplied from the high concentration developer tub 84 to the standard developer tub 100, and a predetermined amount of the dilution liquid D is supplied from the dilution liquid tub 86 to the standard developer tub 100. The supply amount of the developer GH and the supply amount of the dilution liquid D to the standard developer tub 100 are established in advance based on the solid component concentration CS (CSH) of the developer GH of the high concentration developer tub 84 and the target concentration TC. As a result of this, the developer SG, in which the solid component concentration SC is the target concentration TC, is prepared in the standard developer tub 100 without performing adjustment of the solid component concentration SC.

Figure 6:
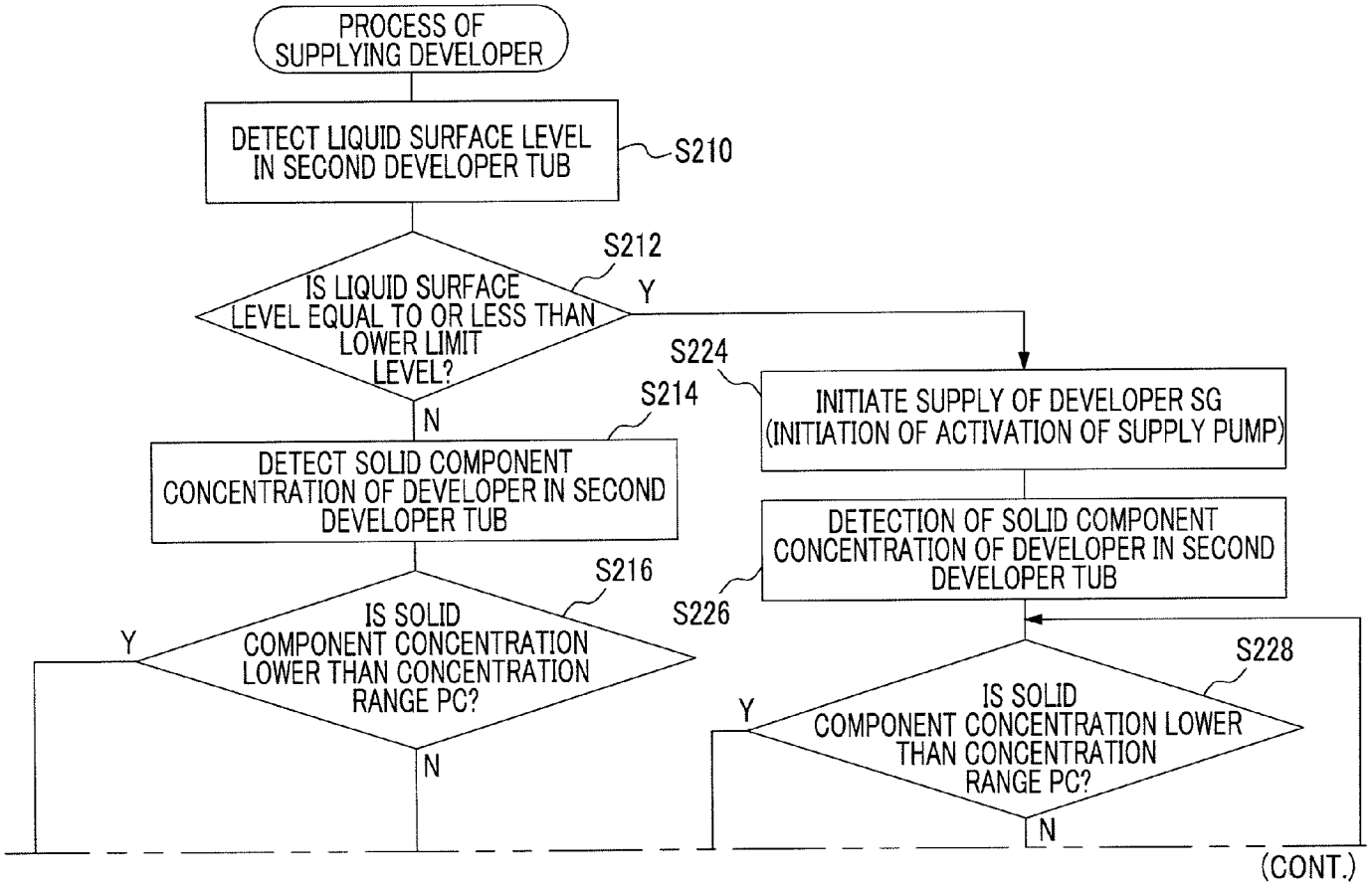
FIG. 6 is a flowchart that shows an example of a process of supplying developer to a developer tub.

Meanwhile, FIG. 6 shows an example of a process of supplying the developer G to the developer tub 72. This flowchart is executed with a predetermined timing during a predetermined time interval from after the developer apparatus initiates operation up until operation is completed. Additionally, the developer apparatus 70 uses the supply pump 92 in the supply of the developer GH to the developer tub 72 and uses the dilution pump 94 in the supply of the dilution liquid D to the developer tub 72. Because of this, prior to the activation of the supply pump 92 and the dilution pump 94, the switching valves 102 and 104 are activated in advance so that the developer GH and the dilution liquid D are supplied to the developer tub 72.

In the initial Step S210, the liquid surface level of the developer G in the developer tub 72 is detected by the liquid surface level sensor 114 that is provided in the developer tub 72. In the next Step S212, it is confirmed whether or not the liquid surface level reaches the predetermined lower limit level $L_1$.

In a case in which the liquid surface level of the developer G in the developer tub 72 does not reach the lower limit level $L_1$ (in a case in which the liquid surface level is a level that is higher than the lower limit level $L_1$), a negative determination is made in Step S212, and the process moves to Step S214. In Step S214, the solid component concentration SC of the developer G in the developer tub 72 is detected by the concentration sensor 96 that is provided in the developer tub 72.

Subsequently, in Step S216, it is confirmed whether or not the detected solid component concentration SC is lower than the predetermined concentration range PC (the lower limit concentration $PC_L$), and in Step S218, it is confirmed whether or not the detected solid component concentration SC is higher than the predetermined concentration range PC (the upper limit concentration $PC_H$).

In the exemplary embodiment, as an example, the predetermined concentration range PC is adopted, but the exemplary embodiment is not limited to this, and the target concentration TC may be adopted. In this case, in Step S216, it is confirmed whether or not the solid component concentration SC is lower than the predetermined target concentration TC (SC<TC), and in Step S218, it is confirmed whether or not the solid component concentration SC is higher than the predetermined target concentration TC (SC>TC).

When the solid component concentration SC of the developer G decreases, and is less than the lower limit concentration $PC_L$ of the concentration range PC ($SC<PC_L$), a positive determination is made in Step S216, and the process moves to Step S220. In Step S220, a predetermined amount of the developer GH is supplied from the high concentration developer tub 84 to the developer tub 72 by activating the supply pump 92 for a predetermined amount of time only. The solid component concentration SC of the developer G in the developer tub 72 is raised by supplying the developer GH.

When the solid component concentration SC of the developer G increases, and is more than the upper limit concentration $PC_H$ of the concentration range PC ($SC>PC_H$), a positive determination is made in Step S218, and the process moves to Step S222. In Step S222, a predetermined amount of the dilution liquid D is supplied from dilution liquid tub 86 to the developer tub 72 by activating the dilution pump 94 for a predetermined amount of time only. The solid component concentration SC of the developer G in the developer tub 72 is lowered by supplying the dilution liquid D.

In the developer apparatus 70, the solid component concentration SC of the developer G in the developer tub 72 is adjusted and retained in the predetermined concentration range PC ($PC_L \leq SC \leq PC_H$) as a result of the processes of Step S214 to Step S222 being repeated. Additionally, the amounts of the developer GH and the dilution liquid D that are supplied to the developer tub 72 are not limited to predetermined amounts, and for example, may be set depending on a difference between the solid component concentration SC and the target concentration TC, and adjusted so that the solid component concentration SC of the developer G becomes the target concentration TC as a result.

Meanwhile, the amount of the developer G in the developer tub 72 is reduced as a result of the developer G being consumed in the image forming apparatus 10. As a result of this, when the liquid surface level of the developer G in the developer tub 72 reaches less than or equal to the lower limit level $L_1$, a positive determination is made in Step S212, and the process moves to Step S224. In Step S224, the activation of the supply pump 108 is initiated. As a result of this, the developer SG that is prepared to the target concentration TC is supplied from the standard developer tub 100 to the developer tub 72.

When the activation of the supply pump 108 is initiated, in Step S226, the solid component concentration SC of the developer G in the developer tub 72 is detected by the concentration sensor 96. Subsequently, in Step S228, it is confirmed whether or not the detected solid component concentration SC is lower than the predetermined concentration range PC, and in Step S230, it is confirmed whether or not the detected solid component concentration SC is higher than the predetermined concentration range PC. Furthermore, in Step S232, it is confirmed whether or not the activation time of the supply pump 108 has reached a predetermined time (whether or not a predetermined time has elapsed since activation of the supply pump 108). That is, it is confirmed whether or not the supply of a predetermined amount (an amount at which the liquid surface level of the developer G reaches a predetermined level SL) of the developer SG is completed.

When a positive determination is made in Step S232, the process moves to Step S234, the supply pump 108 is stopped, and the supply of the developer SG to the developer tub 72 is completed. When the solid component concentration SC of the developer G in the developer tub 72 decreases, and is less than the lower limit concentration $PC_L$ of the concentration range PC ($SC<PC_L$), a positive determination is made in Step S228, the process moves to Step S236, the supply pump 92 is activated and the developer GH is supplied to the developer tub 72. Furthermore, when the solid component concentration SC of the developer G increases, and is more than the upper limit concentration $PC_H$ of the concentration range PC ($SC>PC_H$), a positive determination is made in Step S230, the process moves to Step S238, the dilution pump 94 is activated, and the dilution liquid D is supplied to the developer tub 72.

In the developer apparatus 70, in a case in which the developer G in the developer tub 72 decreases, since the developer SG in which the solid component concentration SC is adjusted to the target concentration, is supplied to the developer tub 72, the solid component concentration SC of the developer G in the developer tub 72 changes toward the target concentration TC. Accordingly, in the developer apparatus 70, when the amount of the developer G in the developer tub 72 increases, at least a circumstance in which the solid component concentration SC deviates from the predetermined concentration range PC is suppressed. In addition, in the developer apparatus 70, concentration adjustment is carried out even during supply of the developer SG to the developer tub 72 by supplying the developer GH and the dilution liquid D. As a result of this, in the image forming apparatus 10, which performs image formation using the developer G that is supplied from the developer tub 72, a circumstance in which the quality of images that are formed on the film 12 is affected as a result of changes in the solid component concentration SC of the developer G, is suppressed.

In the abovementioned description, concentration adjustment of the developer G in the developer tub 72 is performed during the supply of the developer SG to the developer tub 72, but the concentration adjustment of the developer G in the developer tub 72 may be performed after the supply of the developer SG is completed.

In the exemplary embodiment, which is described above, the supply of the developer GH and the dilution liquid D to the developer tub 72, and the supply of the developer GH and the dilution liquid D to the standard developer tub 100 are performed using the supply pump 92 and the dilution pump 94 by providing the switching valves 102 and 104, but the invention is not limited to this configuration. For example, in place of the switching valves 102 and 104, and the branched pipe 88A and 90A, a liquid feed pipe and a supply pump, which supply the developer GH from the high concentration developer tub 84 to the standard developer tub 100, and a liquid feed pipe and a dilution pump, which supply the dilution liquid D from the dilution liquid tub 86 to the standard developer tub 100 may be provided.

Furthermore, in the exemplary embodiment, the liquid surface level sensors 114 and 116 are used in the detection of the amounts of the developer G and the developer SG, but the detection of the amounts is not limited to the detection of liquid surface levels. For example, the weight of the developer G that is accommodated in the developer tub 72, and the weight of the developer SG that is accommodated in the standard developer tub 100, may be detected as the amounts. The amount of the developer G may be calculated by adding and subtracting the amount of the developer G that is supplied to the developing tank 58 from the developer tub 72, and the amount of the developer G that is recovered to the developer tub 72. The amount of the developer SG may be calculated by adding and subtracting the amount of the developer SG that is supplied to the developer tub 72 from the standard developer tub 100, and the amounts of the developer GH and the dilution liquid D that are supplied to the standard developer tub 100.

In the exemplary embodiment, the developer SG is prepared by supplying the developer GH and the dilution liquid D to the standard developer tub 100, but the invention is not limited to this, and a configuration in which the developer SG where the solid component concentration SC is prepared to the predetermined target concentration TC, is supplied to the standard developer tub 100 may also be used.

Furthermore, as long as the developer apparatus has a configuration that accommodates a liquid developer in which the solid component concentration is prepared so as to become a target concentration within a predetermined concentration range, and supplies the accommodated liquid developer so as to suppress liquid surface decreases in a developer tub, in which a developer that is used in image formation is accommodated, it is possible for the developer apparatus to have various configurations.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer supply device comprising:

a plurality of accommodation tubs comprising:

(1) a liquid developer accommodation tub that accommodates a liquid developer that is used in image formation and includes toner as a solid component, wherein liquid developer is fed directly from the liquid developer accommodation tub to a developing device via a feed line from the liquid developer accommodation tub, (2) a high concentration liquid developer accommodation tub that accommodates a high concentration liquid developer in which a solid component concentration is higher than a predetermined concentration range, (3) a dilution liquid accommodation tub that accommodates a dilution liquid, and (4) a standard concentration liquid developer accommodation tub that accommodates a standard concentration liquid developer in which a solid component concentration is adjusted to a target concentration within a concentration range, wherein high concentration liquid developer feed lines allow the high concentration liquid developer to be fed from the high concentration liquid developer accommodation tub directly to the liquid developer accommodation tub and to the standard concentration liquid developer accommodation tub, and dilution liquid feed lines allow the dilution liquid to be fed from the dilution liquid accommodation tub directly to the liquid developer accommodation tub and to the standard concentration liquid developer accommodation tub;

a first detection section associated with the liquid developer accommodation tub and that detects a solid component concentration of the liquid developer, and an amount of the liquid developer that is accommodated in the liquid developer accommodation tub; and a control section that controls the solid component concentration of the liquid developer to within the concentration range by supplying at least one of the high concentration liquid developer and the dilution liquid to the liquid developer accommodation tub based on detection results that are detected by the first detection section, and controls the amount of the liquid developer in the liquid developer accommodation tub to greater than or equal to a predetermined amount by supplying the standard concentration liquid developer from the standard concentration liquid developer accommodation tub to the liquid developer accommodation tub.

2. The liquid developer supply device according to claim 1, wherein, when the solid component concentration of the liquid developer detected by the first detection section is lower than the predetermined concentration range, the control section controls to supply the high concentration liquid developer to the liquid developer accommodation tub.

3. The liquid developer supply device according to claim 1, wherein, when the solid component concentration of the liquid developer detected by the first detection section is higher than the predetermined concentration range, the control section controls to supply the dilution liquid to the liquid developer accommodation tub.

4. The liquid developer supply device according to claim 1, wherein the control section performs control of preparing the standard concentration liquid developer by supplying the high concentration liquid developer and the dilution liquid to the standard concentration liquid developer accommodation tub.

5. The liquid developer supply device according to claim 4, further comprising:

a second detection section that detects an amount of the standard concentration liquid developer in the standard concentration liquid developer accommodation tub, wherein the control section performs control of supplying the high concentration liquid developer and the dilution liquid to the standard concentration liquid developer accommodation tub at a ratio that achieves the target concentration through mixing when the amount of the standard concentration liquid developer decreases to a predetermined amount based on detection results of the second detection section.

6. The liquid developer supply device according to claim 1, further comprising:

a recovery unit that recovers liquid developer, which is supplied and is not used in image formation, to the liquid developer accommodation tub.

7. An image forming apparatus comprising:

the liquid developer supply device according to claim 1; and an image forming unit that forms images on a recording medium using the liquid developer that is supplied from the liquid developer supply device.

8. The liquid developer supply device according to claim 6, wherein the amount of the liquid developer that is accommodated in the liquid developer accommodation tub is detected by any one of a liquid surface level of the liquid developer in the liquid developer accommodation tub, a weight of the liquid developer in the liquid developer accommodation tub, and a calculation based on an amount of the liquid developer supplied from the liquid developer accommodation tub and an amount of the recovered liquid developer that is received into the liquid developer accommodation tub.

9. The liquid developer supply device according to claim 5, wherein the amount of the standard concentration liquid developer that is accommodated in the standard concentration liquid developer accommodation tub is detected by any one of a liquid surface level of the standard concentration liquid developer in the standard concentration liquid developer accommodation tub, a weight of the standard concentration liquid developer in the standard concentration liquid developer accommodation tub, and a calculation based on an amount of the high concentration liquid developer and the dilution liquid that is supplied to the standard concentration liquid developer accommodation tub.

* * * * *